United States Patent [19]

Schreiner et al.

[11] 4,334,929

[45] Jun. 15, 1982

[54] USE OF NICKEL-COBALT SINTERED MATERIALS FOR ELECTRIC RELAY CONTACTS

[75] Inventors: Horst Schreiner; Reinhard Tusche, both of Nuremberg, Fed. Rep. of Germany; Sjouke Zijlstra, SE Geldrop, Netherlands

[73] Assignee: Siemens Aktiengesellschaft, Munich, Fed. Rep. of Germany

[21] Appl. No.: 171,369

[22] Filed: Jul. 23, 1980

[30] Foreign Application Priority Data

May 28, 1980 [DE] Fed. Rep. of Germany ..... 3020277

[51] Int. Cl.[3] ..... B22F 5/00

[52] U.S. Cl. ..... 75/246; 200/262; 200/265; 200/266; 148/425; 420/435

[58] Field of Search ..... 75/246, 170; 200/262, 200/265, 266

[56] References Cited

U.S. PATENT DOCUMENTS

| | | | |
|---|---|---|---|
| 3,626,570 | 12/1971 | Kushnir et al. | 75/246 |
| 3,893,824 | 7/1975 | Tadokoro et al. | 75/170 |
| 4,212,688 | 7/1980 | Makino et al. | 75/170 |

*Primary Examiner*—Brooks H. Hunt
*Attorney, Agent, or Firm*—Kenyon & Kenyon

[57] ABSTRACT

A relay contact made of nickel-cobalt sintered alloys with the composition 50 to 85% nickel and 50 to 15% cobalt is described.

5 Claims, No Drawings

USE OF NICKEL-COBALT SINTERED MATERIALS FOR ELECTRIC RELAY CONTACTS

BACKGROUND OF THE INVENTION

This invention relates to relay contacts in general and more particularly to the use of a sintered material which consists of 50 to 85% nickel and 50 to 15% cobalt, as a material for electric relay contacts.

A small degree of material migration is a requirement for relay contact materials because the switching operation can be disturbed by the development of hills and valleys resulting in failure of the relays. A further requirement is low contact resistance. In contact materials containing silver, sulfide layers cause an unfavorable increase of the contact resistance values. For this reason, palladium alloys have been used which form substantially less sulfide film on the contact surface and therefore have lower, more favorable contact resistance. This, however, involves contact materials rich in rare metals.

It is thus, an object of the present invention to find a sintered material with a low rare metal content for use as the contact material for electric relay contacts of the nickel-cobalt type which exhibits great hardness and practically no increase of the contact resistance and practically no material migration under current load.

SUMMARY OF THE INVENTION

According to the present invention, this problem is solved through the use of a sintered material which consists of 50 to 85% nickel and 50 to 15% cobalt.

It was surprising that sintered NiCo alloys such as NiCo25 (mass percent) show no material migration to a bothersome extent when DC currents are switched in relays such as is the case, for instance, in blinker relays of motor vehicles. With respect to this property, these sintered contact materials are very similar to alloys with a large content of palladium. Another surprising effect occurred when contact resistance values were measured. Tests with a blinker lamp as the load showed no failures due to sticking, welding or an increase of the contact resistance. It is a further advantage of this contact material that its content of rare metals is relatively low.

DETAILED DESCRIPTION OF THE INVENTION

Examples for particularly advantageous nickel-cobalt sintered materials are compositions with 85% nickel and 15% cobalt; 75% nickel and 25% cobalt; 65% nickel and 35% cobalt; and 50% nickel and 50% cobalt.

In particular, the sintered material NiCo25 is suitable as a replacement for the contact material PdCu15 used heretofore as the movable contact in blinker relays for motor vehicles (warning blinkers, directional signal blinkers). It shows only an extremely small amount of material migration and sufficiently low contact resistance for up to $8\times10^5$ switching cycles. Tests with a blinking lamp as a load showed no failures due to sticking, welding or an increase in the contact resistance.

After storage in an aggressive atmosphere, for instance, in hydrochloric acid vapors and after salt spray tests, no impairment of the switching operation was found either.

Sintered materials of this type can be advantageously produced using well known powder metallurgical methods.

What is claimed is:

1. An electrical relay contact made of a sintered material which consists of 50 to 85% nickel and 50 to 15% cobalt.

2. The contact according to claim 1 which consists of 85% nickel and 15% cobalt.

3. The contact according to claim 1 which consists of 75% nickel and 25% cobalt.

4. The contact according to claim 1 which consists of 65% nickel and 35% cobalt.

5. The contact according to claim 1 which consists of 50% nickel and 50% cobalt.

* * * * *